US006883886B2

(12) United States Patent
Salice

(10) Patent No.: US 6,883,886 B2
(45) Date of Patent: Apr. 26, 2005

(54) DRAWER GUIDE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 46 days.

(21) Appl. No.: 10/157,767

(22) Filed: May 29, 2002

(65) Prior Publication Data

US 2003/0052579 A1 Mar. 20, 2003

(30) Foreign Application Priority Data

Aug. 29, 2001 (IT) ..... MI2001A1821

(51) Int. Cl.[7] ..... A47B 88/00
(52) U.S. Cl. ..... 312/348.1; 312/330.1
(58) Field of Search ..... 312/348.1, 348.2, 312/348.4, 330.1, 263, 333; 403/279, 282, 283, 409.1

(56) References Cited

U.S. PATENT DOCUMENTS 4,653,821 A * 3/1987 Faust ..... 312/334.38
4,875,746 A * 10/1989 Rock et al. ..... 312/330.1
5,090,786 A 2/1992 Albiez et al.
5,147,123 A * 9/1992 Berger ..... 312/348.1
5,462,349 A * 10/1995 Grabher ..... 312/348.1
5,556,183 A * 9/1996 Brustle et al. ..... 312/348.1
5,681,101 A 10/1997 Peter
6,053,592 A * 4/2000 Sutterlutti ..... 312/330.1
6,378,967 B1 * 4/2002 Moser et al. ..... 312/334.1

FOREIGN PATENT DOCUMENTS

| | | | | |
|---|---|---|---|---|
| AT | 344 362 | | 7/1978 | |
| DE | 41 39 441 | | 6/1992 | |
| EP | 322545 | * | 7/1989 | ..... 312/348.1 |
| GB | 2 196 835 | | 5/1988 | |

* cited by examiner

*Primary Examiner*—James O. Hansen
(74) *Attorney, Agent, or Firm*—Herbert Dubno

(57) ABSTRACT

A drawer guide for a wall of a drawer and adapted to fit on the underside thereof. Drawer guide has a first flange underlying the wall and a second flange lying along on side of that wall and anchored therein. A tab on the first flange lies perpendicular to the plane of that flange and has a hook engaging in the wall. The first flange can be expanded to the thickness of the wall.

9 Claims, 2 Drawing Sheets

DRAWER GUIDE

FIELD OF THE INVENTION

The present invention relates to a drawer guide and to a procedure for making and assembling it to a wall of a drawer.

BACKGROUND OF THE INVENTION

As is known drawer guides comprise a body which has a lower side, which is connected to the base of the side walls of the drawer, having a transverse extent (width) which is greater than the thickness of the aforementioned side walls of the drawer.

The guide also comprises hooks which are connected to the side wall of the drawer.

Such a traditional drawer guide has some drawbacks, mainly due to the fact that, since the lower side of the guide has a transverse extent which is greater than the thickness of the walls of the draw, a substantial amount of material is consumed and there is a substantial amount of swarf.

OBJECT OF THE INVENTION

The object of the present invention is, therefore, to provide a drawer guide and a method for the making and assembly thereof, which allow the aforementioned drawbacks of the prior art to be eliminated.

Another object is to provide a drawer guide and a method of making and assembling it which allow the material consumption to be substantially reduced with respect to that which is necessary in the prior art.

Another object of the invention is to provide a guide and a process which allow the production of very strong hooking tabs which guarantee an excellent attachment of the guide to the drawer, since the strong section of the tabs is defined by the width of the tabs themselves and not by the thickness of the material.

It is an object of the invention to provide a guide and method which can yield tabs which are very strong, since they are not subjected to multiple deformations which can cause the weakening thereof.

SUMMARY OF THE INVENTION

These objects are achieved, according to the present invention, in a quick-assembly drawer guide comprising a shaped body with, on a support surface of a wall of the side of a drawer, a connection device for attaching the body to the wall. The connection device comprises at least one first member for attaching to the wall and means for deforming a portion of the support surface for the displacement of said first attachment member along a direction perpendicular to the axis of the body up to a position substantially coinciding with the thickness of the wall.

Advantageously, the present invention also includes a method for making and assembling a drawer guide. The method consists of shearing a slot on the surface of the guide suitable for supporting a wall of the side of the drawer and at the same time two opposite tabs leaving a staple between the tabs and the slot, of shearing a point facing the staple on the vertical side of the guide, of deforming the slot to displace the tabs simultaneously along a direction perpendicular to the axis of the guide up to a position substantially coinciding with the thickness of the wall, of associating the wall with the guide, of bending the tabs by 90° and of applying a pressure on the tabs and said point against said wall to anchor them to it.

The maximum width of the surface of the body can be less than the minimum thickness of the wall of the drawer. The assembly can comprise at least one second attachment member engaged with said wall on the opposite side to the first member.

The first attachment member can comprise a tab extending on the same plane as the surface of the body and equipped at its end with a hooking head.

The device can comprise at least two identical tabs arranged facing each other. The tabs can have their bending line perpendicular to the axis of the body. The deformation means can comprise at least one slot extending parallel to the axis of the body and defining a staple supporting the two tabs on a portion of the surface of the body. The slot can have widened zones at its ends to ease the deformation of said portion and the displacement of said staple and the tabs beyond the maximum width of said surface.

The second member can engage in the wall in a zone which is equidistant from the tabs.

BRIEF DESCRIPTION OF THE DRAWING

Further characteristics and advantages of the invention shall become clearer from the following description of a preferred but not exclusive embodiment of the drawer guide and the method given with reference to the accompanying drawing, wherein.

SPECIFIC DESCRIPTION

Figure 1:
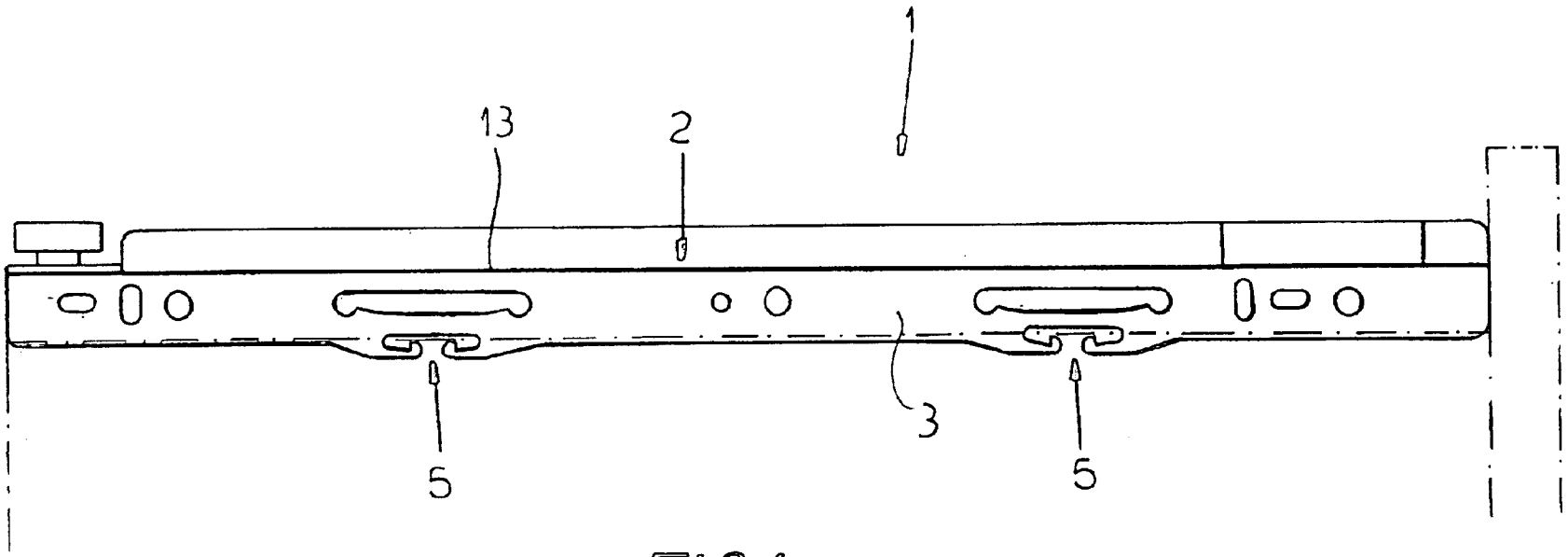
FIG. 1 is a plan view of a drawer guide according to the invention associated with a drawer (shown with a dot dash line) before the tabs are bent.
Figure 2:
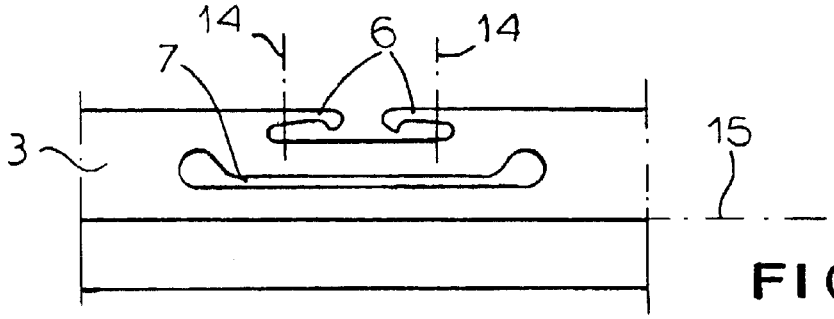
FIG. 2 is a plan view of a portion of the guide according to the invention which has not been deformed.
Figure 3:
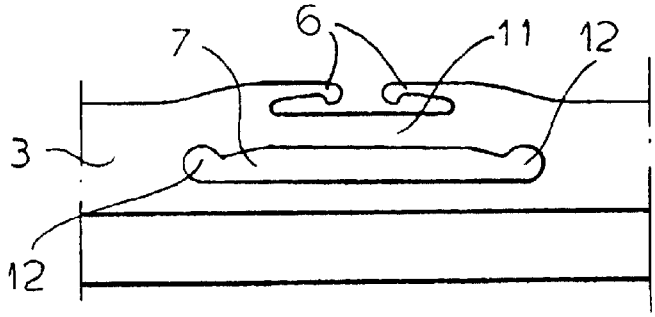
FIG. 3 is a plan view of the portion of the guide of FIG. 2 when it has been deformed.
Figure 4:
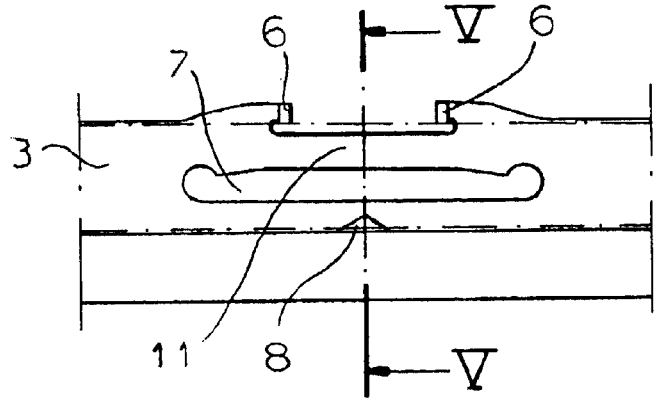
FIG. 4 is a plan view of the portion of guide of FIG. 3 associated with a drawer wall shown with a dot dash line, with the tabs and an attachment member folded.

The drawing shows a drawer guide indicated as a whole with the reference numeral 1.

Figure 5:
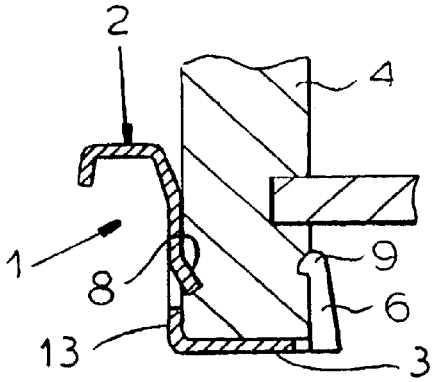
FIG. 5 is a section taken along the line V—V of FIG. 4.
Figure 6:
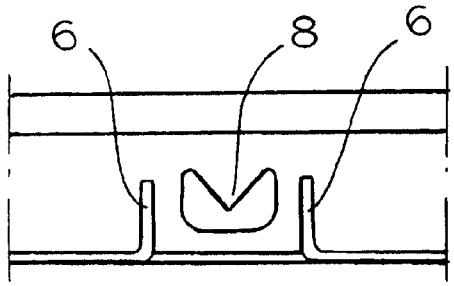
FIG. 6 is a front view of the guide not applied to the drawer.

The guide 1 is of the quick assembly type and comprises a shaped body 2 which has a support surface or a first flange 3 adapted to lie against the underside of a wall 4 of the side of the drawer. A connection device 5 is provided on the first flange 3 for the attachment of the body 2 to such a wall 4. The body 2 has a second flange 13 formed at an angle (FIG. 5) to the first flange 13 and adapted to be alongside the wall 4.

The connection device 5 comprises at least one first member 6 (first attachment member on the first flange 3) for the attachment to the wall, and means 7 for enabling deformation of a portion of the surface or first flange 3, for the displacement of the first attachment member 6 along a direction perpendicular to the axis of the body 2 up to a position spaced from the second flange 13 by a distance substantially coinciding with the thickness of the wall 4.

Advantageously, the maximum width of the surface or first flange 3 of the body 2 is less than the minimum thickness of the wall 4 of the drawer.

The guide 1 comprises, moreover, a second attachment member 8 on the second flange 13 engaging with the wall 4 on the opposite side to the first member 6. As shown in the figures, the first attachment members 6 comprise a tab which extends on the same plane as the surface of the body 2 and which is equipped at its end with a hooking head 9.

In particular, the guide according to the invention comprises at least two tabs 6 which are identical and arranged facing one another. Advantageously, the tabs 6 have bending lines 14 perpendicular to the axis 15 of the body.

Moreover, the deformation means 7 comprise at least one slot which extends parallel to the axis of the body and which defines, on a portion of the surface 3 of the body, a staple bar 11 which supports the two tabs 6.

The slot 7 has widened zones 12 at its ends to ease the deformation of the portion of the surface 3 of the body and the displacement of the staple bar 11 and of the tabs 6 beyond the maximum width of the surface 3.

In a preferred embodiment, the second member 8 engages in the wall 4 in a zone which is equidistant from the tabs 6.

The present invention also includes a method of making the drawer guide.

The procedure consists of shearing (cutting) the slot 7 into the horizontal web 3 of the guide 1, suitable for supporting the wall 4 of the side of the drawer and, at the same time, two opposite tabs 6, leaving a staple bar 11 between said tabs and the slot 7.

The procedure also consists of shearing (cutting) a point 8 facing towards the staple 11 on the vertical side or web of the guide 1 and of deforming the slot 7 to displace the tabs 6 simultaneously along a perpendicular to the axis of the guide 1, up to a position substantially coinciding with the thickness of the wall 4.

The procedure also consists of associating the wall 4 with the guide 1, of bending the tabs 6 by 90° and of applying a pressure on the tabs 6 and on the point 8 against the wall 4 to anchor them to it.

Advantageously, the tabs 6 have their bending lines perpendicular to the axis of the guide 1.

Moreover, the slot 7 has widened zones 12 at its ends to ease the deformation of the slot 7 and the displacement of the staple bar 11 and of the tabs 6 beyond the original maximum width of the surface 3.

In practice it has been noted how the drawer guide and the procedure for the realization and the assembly thereof according to the invention are particularly advantageous because they allow material to be saved with respect to the prior art and the reduction of swarf.

In practice, therefore, the guides according to the finding are very cost-effective.

The drawer guide and the method of making and for the assembly therefor thus conceived are susceptible to numerous modifications and variants, all falling within the scope of the inventive concept; moreover, all of the details can be replaced with technically equivalent elements.

In practice, the materials used, as well as the sizes, can be whatever according to the requirements and the state of the art.

What is claimed is:

1. The combination with a drawer having a wall of a quick-assembly drawer guide adapted to fit onto an underside of a said wall of a said drawer, said drawer guide comprising an elongated shaped body provided with a first flange adapted to underlie the underside of said wall and a second flange at an angle to said first flange and adapted to lie alongside one side of said wall, a first attachment member on said first flange opposite said second flange and engageable with an opposite side of said wall, and means enabling deformation of said first flange in a region of said first attachment member and in a plane of said first flange to a position in which said first attachment member is spaced from said second flange by substantially a thickness of said wall, said first attachment member including a tab bent out of a plane of said first flange about a bending line perpendicular to a longitudinal axis of said body.

2. The combination defined in claim 1 wherein said first flange has a width prior to said deformation which is less than a minimum thickness of said wall of said drawer.

3. The combination defined in claim 1, further comprising at least one second attachment member on said second flange engageable with said one side of said wall opposite to said first attachment member.

4. The combination defined in claim 3 wherein said tab has a hook at an end thereof and is bendable from said plane into a position perpendicular to said plane.

5. The combination defined in claim 4 wherein said first attachment member includes two of said tabs arranged facing each other.

6. The combination defined in claim 5 wherein said tabs having have bending lines perpendicular to an axis of said body.

7. The combination with a drawer having a wall of a quick-assembly drawer guide adapted to fit onto an underside of said wall of a said drawer, said drawer guide comprising an elongated shaped body provided with a first flange adapted to underlie the underside of said wall and a second flange at an angle to said first flange and adapted to lie alongside one side of said wall, a first attachment member on said first flange opposite said second flange and engageable with an opposite side of said wall, and means enabling deformation of said first flange in a region of said first attachment member to a position in which said first attachment member is spaced from said second flange by substantially a thickness of said wall, said body comprising at least one second attachment member on said second flange engage able with said one side of said wall opposite to said first attachment member, said first attachment member comprising two tabs in a plane of first flange having hooks at ends thereof and bendable from said plane into positions perpendicular to said plane, said means enabling deformation comprising at least one slot in said first flange parallel to an axis of said body and defining a staple supporting the two tabs on a portion of said first flange.

8. The combination defined in claim 7 wherein said slot has widened zones at ends thereof to facilitate deformation of said portion and displacement of said staple and said tabs away from said second flange.

9. The combination defined in claim 7 wherein said second attachment member engages in said one side of said wall equidistantly between said tabs.

* * * * *